US006863364B2

(12) United States Patent
Russell et al.

(10) Patent No.: US 6,863,364 B2
(45) Date of Patent: Mar. 8, 2005

(54) SYSTEMS AND METHODS FOR ESTIMATING PAGES REMAINING FOR A PRINTING DEVICE COMPONENT

(75) Inventors: Alan P. Russell, Boise, ID (US); Santiago I. Rodriguez, Boise, ID (US); Richard M. Wilson, Caldwell, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/438,645

(22) Filed: May 15, 2003

(65) Prior Publication Data

US 2004/0095459 A1 May 20, 2004

Related U.S. Application Data

(60) Provisional application No. 60/427,656, filed on Nov. 19, 2002.

(51) Int. Cl.[7] ..... B41J 29/393; G03G 15/00

(52) U.S. Cl. ..... 347/19; 399/24

(58) Field of Search ..... 347/7, 19, 228, 347/240, 251, 86, 195; 399/23, 24, 26, 27, 12; 358/1.13

(56) References Cited

U.S. PATENT DOCUMENTS

| | | | | |
|---|---|---|---|---|
| 5,797,061 A | | 8/1998 | Overall et al. | 399/27 |
| 5,802,420 A | * | 9/1998 | Garr et al. | 399/27 |
| 6,028,674 A | * | 2/2000 | Tognazzini | 358/1.13 |
| 6,701,096 B2 | * | 3/2004 | Arai et al. | 399/12 |

FOREIGN PATENT DOCUMENTS

| | | |
|---|---|---|
| GB | 2368698 | 5/2002 |

* cited by examiner

*Primary Examiner*—Hai Pham

(57) ABSTRACT

Systems and methods are described herein for estimating a number of remaining pages that may be printed from a printing device using a replaceable component installed in the printing device. If less than a page count threshold has been printed using the replaceable component, then one or more default values pertaining to a consumable item contained in the replaceable component are used for the estimation. After the page count threshold number of pages has been printed using the replaceable component, actual printer usage data relating to the consumable item in the replaceable component is used to derive the estimate.

23 Claims, 3 Drawing Sheets

SYSTEMS AND METHODS FOR ESTIMATING PAGES REMAINING FOR A PRINTING DEVICE COMPONENT

RELATED APPLICATION

This application is a Letters Patent Application that is related to U.S. Provisional Patent Application No. 60/427,656, filed Nov. 19, 2002 by the inventors named herein and entitled "Systems and Methods for Estimating Pages Remaining for a Printing Device Component," also assigned to Hewlett-Packard Corp. The present application is filed within one year of the filing date of said provisional application.

TECHNICAL FIELD

The systems and methods described herein generally relate to printing device image processing. More particularly, the systems and methods described herein relate to estimating a number of pages that can be printed from a printing device replaceable component based on the print usage history of the replaceable component.

BACKGROUND

Printing devices typically use replaceable components that are, or use, consumable materials. For example, a laser printer may utilize a toner cartridge, a photoelectric drum and a fuser that can be used to print a certain number of pages before they must be replaced (Some such items may be integrated into a single replaceable component). Similarly, an inkjet printer may have one or more ink cartridges that contain ink for printing. A printing device can only print as long as each replaceable component has not been exhausted. Usually, when one replaceable component is exhausted, no more printing can be done from the printing device until the replaceable component is replaced.

Because there can be a delay between the time a replaceable component is exhausted and the time the exhausted replaceable component can be replaced, it is generally desirable for a printing device user to know how many pages can be printed from a printing device using the replaceable components currently installed in the printing device. Improved ways are needed to provide a user with this information.

BRIEF DESCRIPTION OF THE DRAWINGS

The present invention is illustrated by way of example and not limitation in the figures of the accompanying drawings. The same numbers are used throughout the figures to reference like components and/or features.

DETAILED DESCRIPTION

Figure 1:
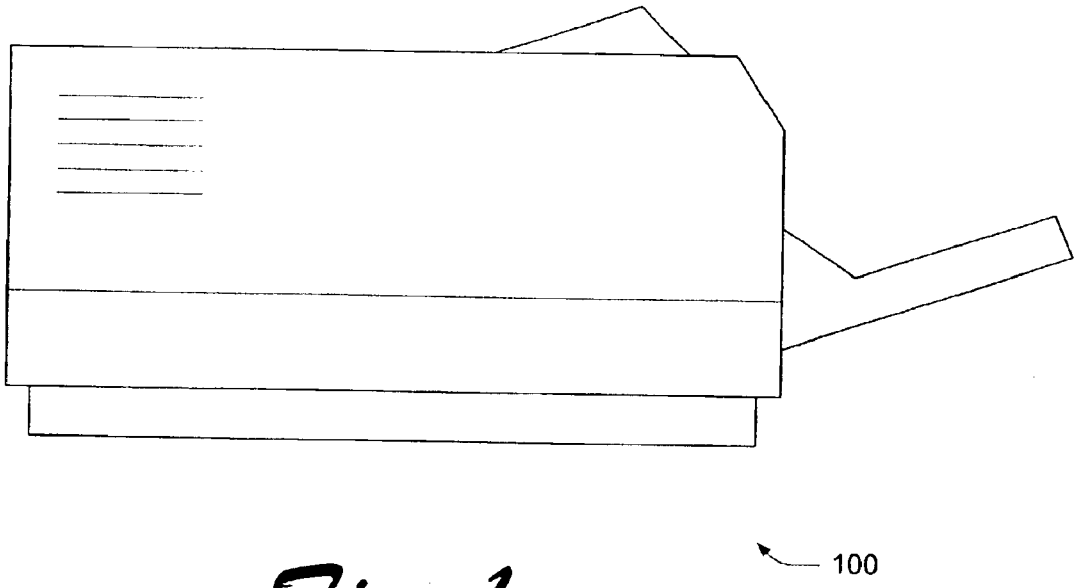
FIG. 1 is a diagrammatic illustration of an exemplary laser printer.

The following description sets forth one or more specific implementations and/or embodiments of systems and methods for estimating a number of pages remaining that can be printed from a printing device that makes use of a replaceable component. Applicant does not intend these exemplary implementations to limit the scope of the claimed invention. Rather, Applicant has contemplated that the claimed systems and methods might also be embodied and implemented in other ways, in conjunction with other present or future technologies.

Computer-Executable Instructions

An implementation of a system and/or method for estimating a number of pages that may be printed by a printing device replaceable component based on a historical usage of one or more consumable items contained in the replaceable component may be described in the general context of computer-executable instructions, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Computer-Readable Media

For purposes of this document, the phrase "computer-readable media" may refer to any available media that can be accessed by a computer. By way of example, and not limitation, computer readable media may comprise "computer storage media" and "communications media."

"Computer storage media" may include volatile and non-volatile, removable and non-removable media implemented in any method or technology for storage of information such as computer readable instructions, data structures, program modules, or other data. Computer storage media includes, but is not limited to, RAM, ROM, EEPROM, flash memory or other memory technology, CD-ROM, digital versatile/video disks (DVD) or other optical storage devices, magnetic cassettes, magnetic tape, magnetic disk storage or other magnetic storage devices, or any other medium which can be used to store the desired information and which can be accessed by a computer.

"Communications media" typically embodies computer-readable instructions, data structures, program modules, or other data in a signal, such as carrier wave, the Public Internet or other transport mechanism. Communication media also includes any information delivery media.

Methods, printing systems, printing devices and computer-readable media, according to various implementations, relate to accurately estimating a number of remaining pages that can be printed by a printer before one or more replaceable components needs to be replaced. The systems and methods take into account actual printing that occurs when the replaceable component is installed in the printing device and, thus, lead to a more accurate pages remaining estimate. The systems and methods take into account the general fact that users typically print the same types of print jobs over and over again.

A sensor determines an amount of a consumable that has been used in a replaceable component. The number of pages printed using the depleted consumable is determined and is used to estimate how many more pages can be printed from the replaceable component with the consumable remaining in the replaceable component. Until the number of pages printed with the replaceable component is sufficient to rely on for the estimation, historical or default data may be used, such as a number of pages that were printed while a previous similar replaceable component was installed, or a number of pages that can be expected to be printed with a typical replaceable component, i.e., a manufacturer default setting.

Some replaceable components may contain more than one consumable item. For example, some laser printer toner cartridges include at least a quantity of toner and a drum, each being a consumable item. In such a case, a minimum estimated pages remaining can be calculated for each consumable to determine the estimated pages remaining for the replaceable component. In another implementation, the consumable of a lesser amount is used to calculate the estimated pages remaining for the replaceable component.

The described implementations may be utilized with various printing device replaceable components, such as toner cartridges, ink cartridges, dry material cartridges, drums, fusers, transfer belts, etc. Furthermore, a number of pages remaining estimates may be derived for more than one replaceable component in a printing device. In such an instance, the final estimated pages remaining value is a minimum value of the estimates derived for the consumable items in the replaceable component.

The pages remaining estimate may be calculated at periodic intervals delineated by time or by a process, such as when (or before) a page is printed from the printing device, or when a print job is submitted to the printing device. The estimated number of pages remaining may be automatically displayed via a user interface on the printing device or on a host computer connected to the printing device. Or, the estimated number of pages remaining may only be displayed in particular circumstances, such as in response to a user request, when a submitted print job page count exceeds the estimate, and so forth.

Exemplary Printing Device

FIG. 1 is a diagrammatic illustration of a laser printer 100 in accordance with the systems and methods described herein. The laser printer 100 is but one of many printing devices in which the described systems and methods may be implemented. The implementations described herein—while described in the context of a laser printer—are not limited to a laser printer, but may be used in any number of different types of printing devices. In particular, the concepts described herein may be implemented in an inkjet printer, a dry material printer, a copier, a facsimile machine, a plotter, and the like.

Exemplary Toner Cartridge

Figure 2:
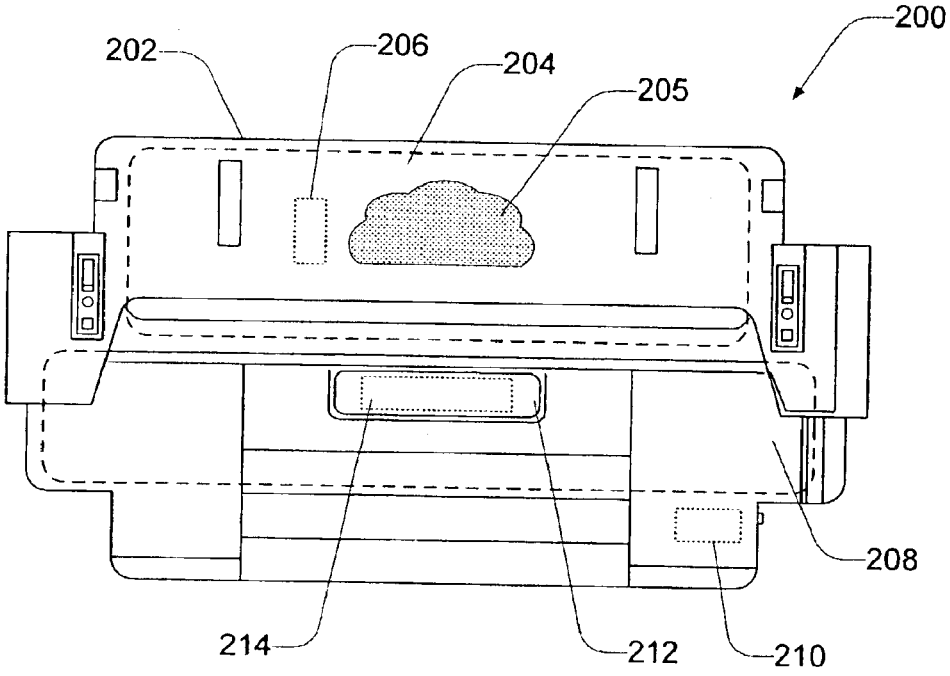
FIG. 2 is a diagrammatic illustration of an exemplary embodiment of a toner cartridge with component memory.

FIG. 2 is a diagrammatic illustration of a laser printer toner cartridge 200 in accordance with the systems and methods described herein. The laser printer toner cartridge 200 is a replaceable component in the laser printer 100 shown in FIG. 1, i.e., the toner cartridge 200 is installable into and removable from the laser printer 100. Although the examples provided herein relate to laser printers and toner cartridges, it is noted that the systems and methods described herein may be implemented with virtually any number of printing device replaceable components. In particular, other printing device replaceable components include but are not limited to ink cartridges, dry material cartridges, drums, fusers, pens, transfer belts, rollers, and the like.

The toner cartridge 200 includes a housing 202, a toner reservoir 204 that stores laser printer toner 205, and a toner level sensor 206 that is configured to determine an amount of toner 205 contained in the toner reservoir 204. In the present example, reference will be made to the toner level sensor 206 providing a measure of a quantity of toner in the toner reservoir 204. The toner sensor 206 may measure available toner by volume or by weight. Furthermore, the toner level sensor 206 may provide the toner level in the form of a percentage, i.e., the amount of toner 205 remaining in the toner reservoir 204 compared to the original amount of toner.

It is noted that there are other ways to measure an amount of toner available for printing, such as resistivity, capacitance of the toner in the developer-OPC gap, magnetic coupling, etc. Any other such method may be used in place of the toner sensor 206 without departing from the scope of the systems and methods described herein.

The toner cartridge 200 also includes a drum 208 and a drum rotation counter 210 that is configure to identify a number of rotations made by the drum 208. As used herein, rotations of the drum 208 are considered to be a consumable item. In other words, the drum 208 is expected to have a life that includes several rotations of the drum 208, and each rotation of the drum 208 lessens an amount of pages that can be printed from the laser printer 100 using the drum 208.

A label 212 that contains information identifying the toner cartridge 200 is affixed to the toner cartridge 200. The label 212 typically recites the name. of the manufacturer, the model number of the cartridge, etc. A memory tag 214 is located underneath the label 212 on the toner cartridge 200, although the memory tag 214 may be placed on or in the toner cartridge 200 at any location which may be practical for the purposes described herein. The memory tag 214, which can be conventional semiconductor memory, can communicate with the laser printer 100 (FIG. 1) by a direct electrical connection thereto, and would be, as such, a direct connection memory tag. Alternatively, the memory tag 214 can be a radio frequency identification (RFID) memory tag.

The memory tag 214 is used to store various data about the toner cartridge 200. Usage data indicating how the laser printer 100 is used, while the toner cartridge 200 is installed in the printer 100, may be stored in the memory tag. 214. For example, average print job length, average page coverage, simplex/duplex printing, pages printed using the toner cartridge, and the like may be stored in the memory tag 214. Other information useful to the implementations described herein may also be stored in the memory tag 214. The information stored in the memory tag 214 will be described in greater detail below, with respect to the following figures.

Exemplary Printing System

Figure 3:
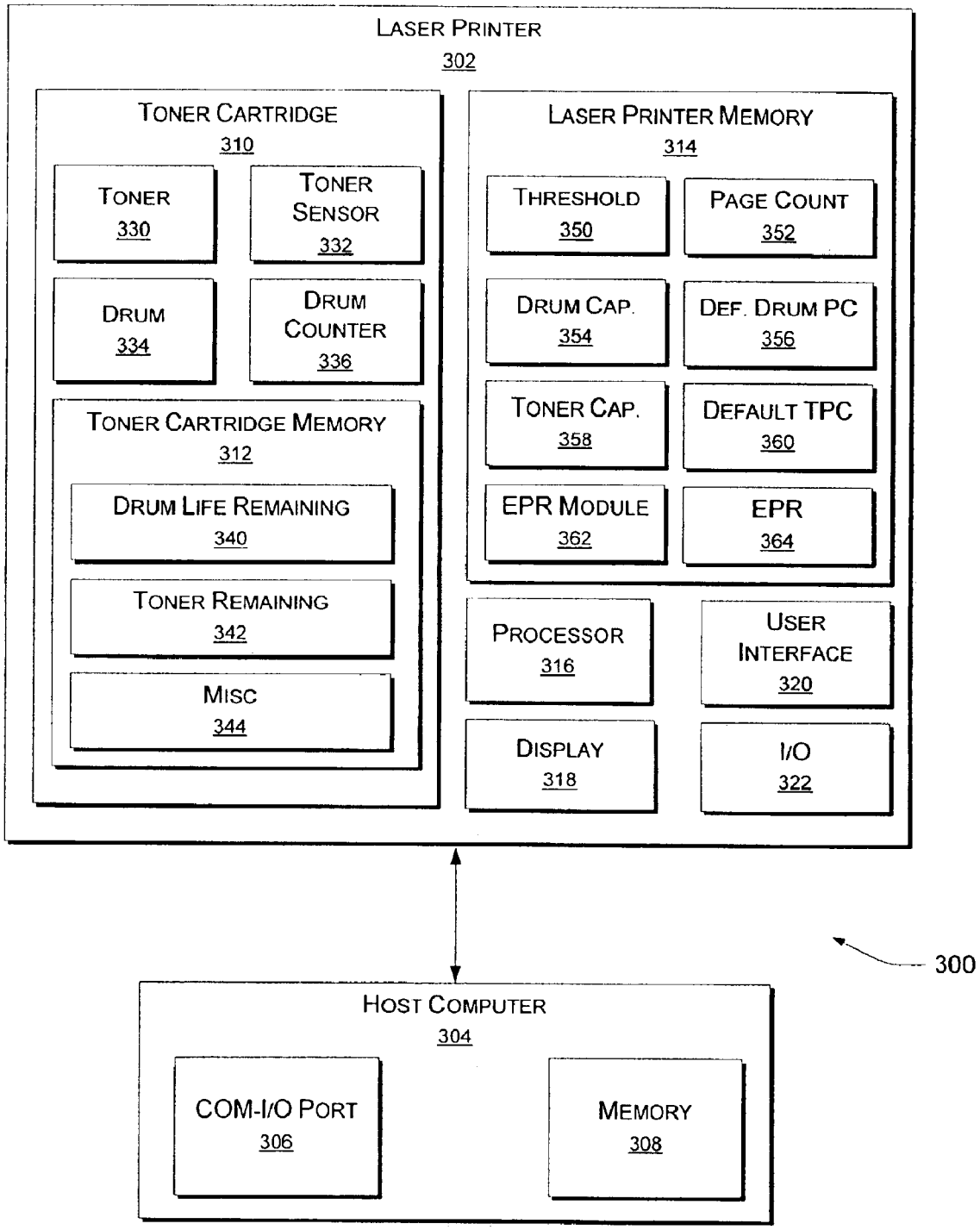
FIG. 3 is a block diagram of an exemplary embodiment of a printing device.

FIG. 3 is a block diagram of an exemplary printing system 300 in accordance with at least one implementation described herein. The exemplary printing system 300 includes a laser printer 302 that is connected to a host computer 304, although the systems and methods described herein may be implemented in a stand-alone printing device or may communicate with one or more computing devices via a network (not shown) such as the Internet. Also, it is noted that the laser printer 302 may be any type of printing device that utilizes at least one replaceable component and is compatible with the implementations described herein. Such types of printing devices includes, but is not limited to: an inkjet printer; dry material printer; copier; fax machine; plotter; etc.

The host computer 304 includes a communications-input/output (COM-I/O) port 306 through which it communicates with the laser printer 302 or a local or wide area network (not shown). The host computer 304 also includes memory 308 that may be used to store data required for the estimated pages remaining techniques described herein. In the present examples, such data is described as being stored in memory in other locations, which will be described in detail below. However, it is noted that data stored in memory in one location may be stored in memory at another location without departing from the scope of the described concepts. The host computer 304 also includes several other components (not shown) required for typical operation of a computer.

The laser printer 302 is shown having a replaceable component, namely, a toner cartridge 310 that has toner cartridge memory 312 integrated therewith. The laser printer 302 also includes laser printer memory 314, a processor 316, a display 318, a user interface 320 and an input/output port 322 through which the laser printer 302 communicates with the host computer 304 and/or a network (not shown), an/or other computers and/or printing devices.

The toner cartridge memory 312 is used to store data related to estimating pages remaining for the toner cartridge 310 and can be conventional semiconductor memory or radio frequency identification (RFID) memory. Since the specific type of memory is not central to the concepts described herein, details as to communication between the toner cartridge memory 312 and the laser printer 302 are not shown in detail. However, those skilled in the art will readily understand additional elements/features that may be needed in the toner cartridge 310 and/or laser printer 302 to support a particular type of toner cartridge memory 312.

The toner cartridge 310 includes toner 330 and a toner level sensor 332 used to measure an amount of toner 330 in the toner cartridge 310. The toner cartridge also includes a drum 334 and a drum counter 336 that counts a number of rotations completed by the drum 334.

The laser printer memory 314 stores a threshold 350 and a page count 352. The page count 352 is a value that identifies a number of pages printed from the laser printer 302 while the toner cartridge 310 is installed. The threshold 350 is a value that, when met or exceeded by the page count 352, indicates that printer usage data related to the toner cartridge 310 shall be used to estimate the number of pages that can be printed from the toner cartridge 310. As long as the page count 352 is less than the threshold 350, then default data is used to calculate the pages remaining estimate.

The laser printer memory 314 also stores a drum capacity 354 that identifies a number of drum rotations that can be expected during the lifetime of the drum 334. The drum capacity 354 may be a value provided by the laser printer manufacturer or the toner cartridge manufacturer. The drum capacity 354 may initially be stored in the toner cartridge memory 312 and utilized from there or transferred to the laser printer memory 314. It is note that the drum capacity 354 is a value and is used (see below) to calculate an estimated pages remaining value for the drum 334.

The laser printer memory 314 also includes a default drum page count 356 that identifies a number of pages expected to be printed with the drum 334. The default drum page count 356 may, in the alternative, be a page count attained during the life of a previously installed drum (not shown).

The laser printer memory 314 also stores a toner capacity 358 and a default toner page count 360. The toner capacity 358 indicates the present amount of toner contained by the toner cartridge 310. The toner sensor 332 uses the toner capacity 358 value to determine a percentage of toner 330 remaining in the toner cartridge 310.

The default toner page count 360 is a predefined page count that is an estimate of a number of pages that can be expected to be printed using the toner 330 originally contained in the toner cartridge 310. The default toner page count 360 may be stored by the printer manufacturer or transferred from the toner cartridge memory 312. Alternatively, the default toner page count 360 is a value that identifies a number of pages printed using a previously installed toner cartridge (not shown).

An estimated pages remaining module 362 is also stored in the laser printer memory 314 and is used to calculate an estimated pages remaining value 364 that identifies a number of pages that can be expected to be printed utilizing the remaining consumable items in the toner cartridge 310, namely, the toner 330 and the drum 334. Details of the operational aspects of the estimated pages remaining module 362 will be discussed below.

The toner cartridge memory 312 stores a drum life remaining value 340 and a toner level sensor value 342. The drum life remaining value 340 is the difference of the drum capacity 354 and the drum counter 336 divided by the drum capacity 354. The drum life remaining value may be expressed as a percentage or a fraction. The toner sensor level value 342 is the amount of toner 330 detected by the toner sensor 332 divided by the toner capacity 358. The toner sensor level value 342 may also be expressed as a percentage or a fraction.

The toner cartridge memory 312 may also store miscellaneous other data 344 such as the default drum page count 356 and/or the default toner page count 360 as described earlier, or other data unrelated to the implementations described herein.

The functionality of the elements and features shown and described in FIG. 3 will be discussed in greater detail below, with reference to FIG. 4.

Methodological Implementation: Estimated Pages Remaining

Figure 4:
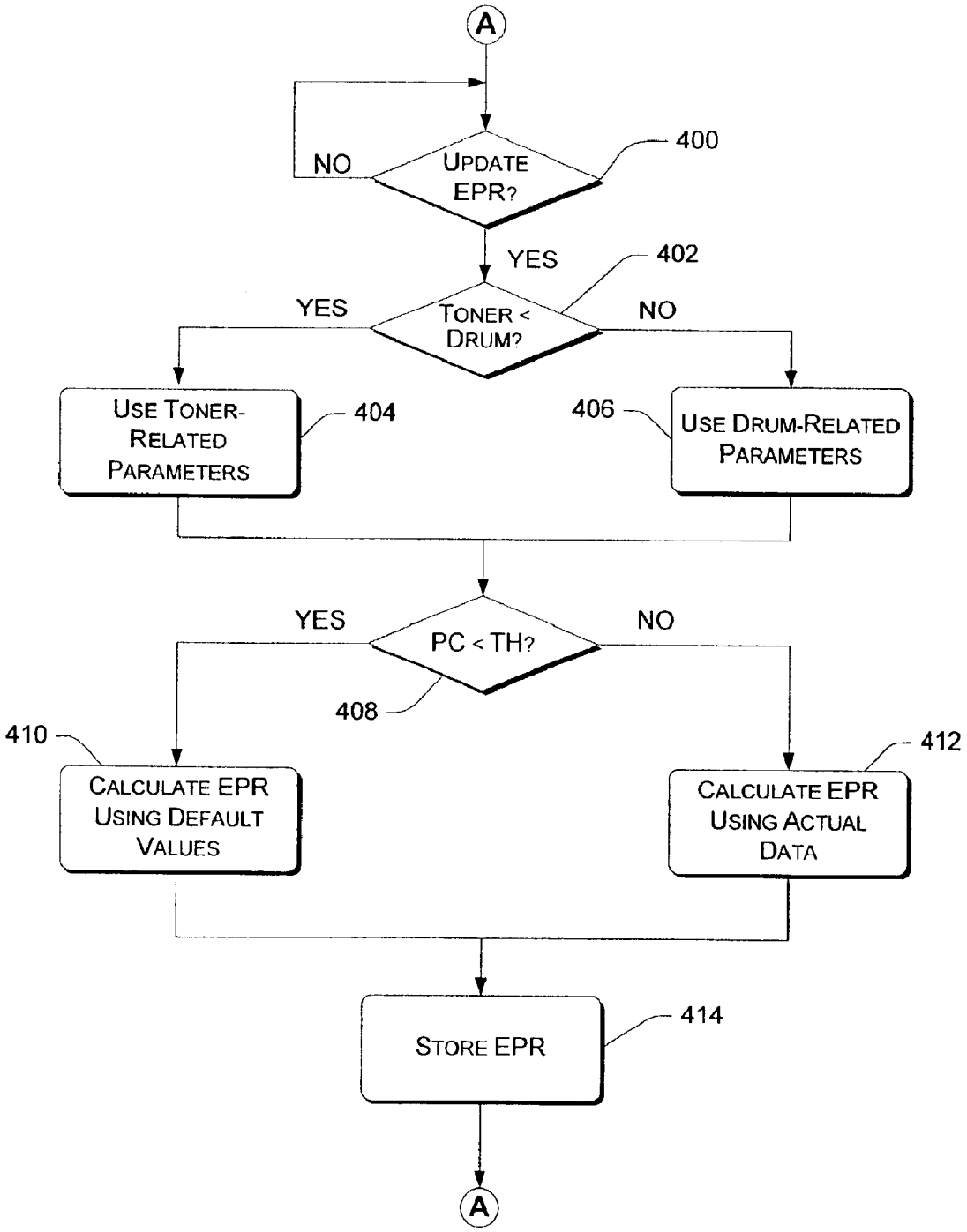
FIG. 4 is flow diagram depicting an exemplary embodiment of an estimated pages remaining methodology.

FIG. 4 is a flow diagram depicting but one implementation of an estimated pages remaining methodology as described herein. In the following discussion, continuing reference will be made to the elements and reference numerals included in FIG. 3.

At block 400, the estimated pages remaining (EPR) module 362 determines when it is time to perform a new estimate of a number of pages that can be printed from the toner cartridge 310 using the consumables contained in the toner cartridge 310—the estimated pages remaining 364. As long as it is not time to update the estimated pages remaining 364 ("No" branch, block 400), then the EPR module 362 continues to monitor the laser printer 302 until it is time to update the estimated pages remaining 364.

The estimated pages remaining 362 may be updated at one or more of several times during the printing process. For example, the estimated pages remaining 362 may be updated before or after each print job, before or after each page is printed, upon request by a user, periodically, etc.

When the EPR module 362 determines that it is time to update the estimated pages remaining 364 for the toner cartridge 310 ("Yes" branch, block 400), the EPR module 362 determines whether to use toner-related values or drum-related values to calculate the EPR 364. If there is less toner 330 life remaining than drum 334 life remaining ("Yes" branch, block 402), then toner-related values are used (block 404). If there is less drum 334 life remaining than toner 330 life remaining ("No" branch, block 402), then drum-related values are used (block 406).

At block 408, the EPR module 362 determines if the page count 352 is less than the threshold 350. If so ("Yes" branch block 408), then there is insufficient printer usage data available to use actual data and default values are used to calculate the estimated pages remaining 364 (block 410).

To calculate the estimated pages remaining 364 using default toner data, the page count 352 is subtracted from the default toner page count 360. Similarly, the estimated pages remaining 364 is derived from default drum data by subtracting the page count 352 from the default drum page count 356.

If, at block 408, the page count 352 is greater than or equal to the threshold 350 ("No" branch, block 408), then the estimate pages remaining 364 is calculated using actual data at block 412.

To calculate the estimated pages remaining 364 from actual toner 330 data, the following equation is used:

$$EPR=TL\%*(PC/(100\%-TL\%)$$

wherein TL % is the percentage of toner 330 remaining in the toner cartridge 310 (toner sensor 332 reading divided by toner capacity 358), and PC is the page count 352.

For example, if the toner sensor 332 has a value of twenty-five percent (25%) and the page count 352 is seventy hundred and fifty (750) pages, then the EPR=25%*(750/75%)=0.25*1000=250 pages. Using the actual toner data provides a more accurate estimate because it is likely that the character of the print jobs printed using the remainder of the toner cartridge 310 life will be similar to the print jobs printed using the depleted portion of the toner cartridge 310.

To calculate the estimated pages remaining 364 from actual drum 334 data, the following equation is used:

$$EPR=DL\%*(PC/(100\%-DL\ \%)$$

wherein DL % is the percentage of drum life remaining and PC is the page count 352. The percentage of drum 334 life remaining is derived from dividing the difference of the drum capacity 354 and the drum counter 336 by the drum capacity 354 (and multiplied times one hundred if a percentage is desired).

For example, if the drum capacity is two thousand (2000) drum rotations, the drum counter 336 has a value of 200, and the page count is two hundred and fifty (250), then the estimated pages remaining 364 is derived by:

$$DL\ \%=(2000-200)/2000*100=90\%$$

$$EPR=90\%*(250/10\%)=2{,}250\ \text{pages.}$$

The estimated pages remaining 364 is stored in the laser printer memory 314 at block 414, where it can be recalled for various printer operations or in response to a user request via the display 318 and/or the user interface 320.

Conclusion

Implementation of the systems and methods described herein provide efficient ways for accurately estimating a number of pages that can be printed from a printing device replaceable component in a printing device. Using actual printer usage data in making the estimation provides a more accurate estimation. As a result, a user retains greater control over print jobs and does not get trapped in a situation where only part of the user's print job prints before the printing device is unable to print any further pages.

Although the disclosed systems and methods have been described in language specific to structural features and/or methodological steps, it is to be understood that the systems and methods defined in the appended claims is not necessarily limited to the specific features or steps described. Rather, the specific features and steps are disclosed as preferred forms of implementing the claimed systems and methods.

What is claimed is:

1. A method, comprising:

determining an amount of a printing consumable item remaining in a printing device replaceable component;

determining a page count that identifies a number of pages printed from the printing device using the replaceable component:

comparing the page count to a page count threshold;

estimating a number of pages that may be printed from the printing device using the replaceable component;

wherein:

the estimating utilizes actual printing device usage data related to the consumable item if the page count is greater than or equal to the page count threshold; and the estimating utilizes one or more default values related to the consumable item if the page count is less than the threshold page count.

2. The method as recited in claim 1, further comprising retrieving the one or more default values from component memory that is integrated with the replaceable component.

3. The method as recited in claim 1, further comprising retrieving the one or more default values from printing device memory.

4. The method as recited in claim 1, wherein:

the consumable item is laser printer toner; and the replaceable component is a toner cartridge.

5. The method as recited in claim 1, wherein:

the consumable item is printer ink; and the replaceable component is an ink cartridge.

6. A method comprising;

determining an amount of laser printer toner remaining in a toner cartridge;

determining a page count that identifies a number of pages printed from the printing device using the toner cartridge;

comparing the page count to a page count threshold;

estimating a number of pages remaining using actual printer usage data according to the following equation if the page count is greater than or equal to the page count threshold $$EPR=TL\ \%*[PC/(100\%-TL\ \%)]$$

where EPR is the estimated pages remaining, TL % is the amount of toner remaining in the toner cartridge, expressed as a percentage, and PC is the page count; and estimating a number of a pages remaining using one or more default values related to the toner cartridge if the count is less than the threshold page count.

7. The method as recited in claim 6, wherein:

estimating a number of pages remaining using one or more default values comprises estimating a number of pages remaining using one or more default values according to the following equation $$EPR=TDPC-PC$$

where EPR is the estimated pages remaining, TDPC is a toner default page count that identifies a number of total pages expected from the replaceable component, and PC is the page count.

8. A method, comprising determining an amount of laser printer drum rotations remaining in a laser printer drum;

determining a page count that identifies a number of pages printed from the printing device using the drum;

comparing the page count to a page count threshold;

estimating a number of pages remaining using actual printer usage data according to the following equation if the page count is greater than or equal to the page count threshold $$EPR=DL\ \%*[PC/(100\%-DL\ \%)]$$

where EPR is the estimated to pages remaining, DL % is the percentage of drum life remaining, end PC is the page count; and estimating a number of pages remaining using one or more default values related to the drum if the page count is less than the threshold page count.

9. A method, comprising:

determining an amount of a printing first consumable item remaining in a printing device replaceable component;

determining an amount of a printing second consumable item remaining in a printing device replaceable component;

determining a page count that identifies a number of pages printed from the printing device using the replaceable component;

comparing the page count to a page count threshold;

estimating a number of pages that may be printed from the printing device using the replaceable component using actual printing device data related to whichever of the first consumable item or the second consumable item is present in a lesser amount if the page count is greater than or equal to the page count threshold; and estimating a number of pages remaining using one or more default values related to whichever of the first consumable item or the second consumable item is present in a lesser quantity if the page count is less than the threshold page count.

10. The method as recited in claim 9, wherein the amount of the first consumable item and the amount of the second consumable item is expressed as a percentage of original capacity.

11. A laser printer, comprising:

a toner cartridge having a toner reservoir that stores a quantity of toner;

a page count identifying a number of pages printed using the replaceable component;

an estimated pages remaining module configured to derive an estimate of a number of pages that may be printed from the laser printer using the toner cartridge; and wherein the estimated pages remaining module is further configured to use one or more default values related to the toner to estimate the pages remaining if the page count is less than a threshold page count, and to use actual print usage date related to the toner to estimate the pages remaining if the page count is greater than or equal to the threshold page count.

12. The laser printer as recited in claim 11, further comprising printer memory, and wherein the threshold page count is stored in the printer memory.

13. The laser printer as recited in claim 11, further comprising toner cartridge memory, and wherein the threshold page count is stored in the toner cartridge memory.

14. The laser printer as recited in claim 11, wherein the estimated pages remaining module is further configured to determine an amount of toner stored in the toner reservoir at any given time.

15. The laser printer as recited in claim 11, further comprising a toner level sensor configured to provide a measurement of an amount of toner remaining in the toner reservoir.

16. A laser printer, comprising:

a toner cartridge having a toner reservoir that stores a quantity of toner;

a page count identifying a number of pages printed using the replaceable component; and an estimated pages remaining module configured to derive an estimate of a number of pages that may be printed from the laser printer using the toner cartridge using one or more default values related to the toner if the page count is less than a threshold page count, and using actual print usage data related to the toner according to the following equation:

$$EPR=TL\ \%*[PC/(100\%-TL\ \%)]$$

If the page count is greater than or equal to the threshold page count, where EPR is the estimated pages remaining, TL % is the amount of toner available divided by the amount of toner originally contained in the toner reservoir, and PC is the page count.

17. A laser printer, comprising:

a toner cartridge having a toner reservoir that stores a quantity of toner;

a page count identifying a number of pages printed using the replaceable component;

an estimated pages remaining module configured to derive an estimate of a number of pages that may be printed from the laser printer using the toner cartridge;

wherein the estimated pages remaining module is further configured to use one or more default values related to the toner to estimate the pages remaining if the page count is less than a threshold page count, and to use actual print usage data related to the toner to estimate the pages remaining if the page count is greater than or equal to the threshold page count; and a drum that has a consumable capacity of a number of drum rotations, and wherein the estimated pages remaining module is further configured to utilize values related to toner to derive the pages remaining estimate it the an amount of toner stored in the toner reservoir compared to an amount of toner originally stored in the toner reservoir is less than a number of drum rotations remaining in the capacity of drum rotations compared to a number of drum rotations originally contained in the capacity of drum rotations.

18. A laser printer, comprising:

a toner cartridge having a toner reservoir that stores a quantity of toner;

a page count identifying a number of pages printed using the replaceable component;

an estimated pages remaining module configured to derive an estimate of a number of pages that may be printed from the laser printer using the toner cartridge;

wherein the estimated pages remaining module is further configured to use one or more default values related to the toner to estimate the pages remaining if the page count is less than a threshold page count; and to use actual print usage data related to the toner to estimate the pages remaining if the page count is greater than or equal to the threshold page count, and a drum that has a consumable capacity of a number of drum rotations, and wherein the estimated pages remaining module is further configured to utilize toner values or drum values, depending on whether there is less toner or drum capacity remaining.

19. The laser printer as recited in claim 18, wherein the pages remaining estimate is derived from solving the following equation:

$$EPR=DL\ \%*[(PC/(100\%-DL\ \%)]$$

if the page count is greater than or equal to the threshold page count, wherein EPR is the estimated pages remaining, DL % is the amount of drum rotations available divided by the number of drum rotations originally contained in the drum, and PC is the page count

20. One or more computer-readable media containing computer-executable instructions that, when executed by a computer, perform the following steps:

accessing a printing material level value that indicates an amount of printing material remaining in a printing device replaceable component installed in a printing device;

accessing a component page count that identifies a number of pages printed from the printing device with the replaceable component installed therein;

accessing a threshold page count;

if the component page count is less than the threshold page count, deriving a pages remaining estimate by subtracting the page count from a default life estimate that identifies an estimate of a number of pages that can be printed using the replaceable component; and if the component page count is greater than or equal to the threshold page count, deriving a pages remaining estimate by taking the product of the percentage of printing material remaining from a printing material capacity and the quotient of the page count divided by the percentage of printing material used from the printing material capacity.

21. The one or more computer-readable media as recited in claim 20, wherein the printing material further comprises laser printer toner and the printing device further comprises a toner cartridge.

22. The one or more computer-readable media as recited in claim 20, wherein the printing material further comprises ink and the printing device further comprises an ink cartridge.

23. One or more computer-readable media containing computer-executable instructions that, when executed by a computer, perform the following steps:

accessing a toner level value that indicates an amount of toner remaining in a laser printer toner cartridge installed in a laser printer;

accessing a drum level value that indicates a number of rotations remaining in a life of a drum integrated into the toner cartridge;

accessing a cartridge page count that identifies a number of pages printed from the laser printer with the toner cartridge installed therein;

determining the lesser of the toner level value and the drum level value;

accessing a threshold page count;

if the cartridge page count is less than the threshold page count, deriving a pages remaining estimate by subtracting the page count from a default capacity value that identifies an estimate of a number of pages that can be printed using the consumable contained in the replaceable component;

if the cartridge page count is greater than or equal to the threshold page count, deriving a pages remaining estimate by taking the product of the percentage of consumable remaining from the default capacity value and the quotient of the page count divided by the percentage of consumable used from the default capacity value; and wherein the consumable is toner and the default capacity value is an original amount of toner when the toner level value is less than the drum level value, and the consumable is drum rotations and the default capacity value is an original number of drum rotations when the drum value is less than the toner value.

* * * * *